US007036822B2

(12) United States Patent
O'Grady

(10) Patent No.: US 7,036,822 B2
(45) Date of Patent: May 2, 2006

(54) POKER GAME SUITABLE FOR GAMING

(76) Inventor: Daniel R. O'Grady, 83 Minnesota St., Rochester, NY (US) 14609

( * ) Notice: Subject to any disclaimer, the term of this patent is extended or adjusted under 35 U.S.C. 154(b) by 101 days.

(21) Appl. No.: 10/823,327

(22) Filed: Apr. 13, 2004

(65) Prior Publication Data

US 2004/0207157 A1 Oct. 21, 2004

Related U.S. Application Data

(60) Provisional application No. 60/474,118, filed on May 29, 2003, provisional application No. 60/463,533, filed on Apr. 17, 2003.

(51) Int. Cl.
*A63F 1/00* (2006.01)

(52) U.S. Cl. ..... 273/292; 273/274

(58) Field of Classification Search ..... 273/292, 273/274

See application file for complete search history.

(56) References Cited

U.S. PATENT DOCUMENTS 5,544,892 A * 8/1996 Breeding ..... 273/292
5,711,525 A * 1/1998 Breeding ..... 273/292
6,019,374 A * 2/2000 Breeding ..... 273/292
6,132,311 A * 10/2000 Williams ..... 463/13
6,273,424 B1 * 8/2001 Breeding ..... 273/292
6,299,534 B1 * 10/2001 Breeding et al. ..... 463/25
6,334,614 B1 * 1/2002 Breeding ..... 273/292
6,454,266 B1 * 9/2002 Breeding et al. ..... 273/292
6,575,465 B1 * 6/2003 Lo ..... 273/292
6,698,757 B1 * 3/2004 Timpano ..... 273/274
6,830,247 B1 * 12/2004 Lo ..... 273/292
6,938,900 B1 * 9/2005 Snow ..... 273/292
6,959,928 B1 * 11/2005 Schultz ..... 273/292
2005/0001378 A1 * 1/2005 Lo ..... 273/292
2005/0029744 A1 * 2/2005 Yoseloff et al. ..... 273/292
2005/0035548 A1 * 2/2005 Yoseloff et al. ..... 273/274
2005/0040599 A1 * 2/2005 Snow ..... 273/292
2005/0040601 A1 * 2/2005 Yoseloff et al. ..... 273/292
2005/0051958 A1 * 3/2005 Snow ..... 273/274
2005/0051960 A1 * 3/2005 Snow ..... 273/274
2005/0051963 A1 * 3/2005 Snow ..... 273/292

* cited by examiner

*Primary Examiner*—Eugene Kim
*Assistant Examiner*—Dolores R. Collins
(74) *Attorney, Agent, or Firm*—Brown & Michaels, PC

(57) ABSTRACT

A poker game based on an Aces and 8's legend pays a high multiple of the amount bet for the highest winning hand containing two pair of aces and 8's, and pays a lower multiple of the amount bet for the second highest winning hand containing two pair other than aces and 8's. A hand of less than a pair and neither an ace nor an 8 wins the amount bet, and all other hands lose. Dealing and betting rules can vary, and the game is adaptable to machine play.

17 Claims, 2 Drawing Sheets

POKER GAME SUITABLE FOR GAMING

Figure 1:
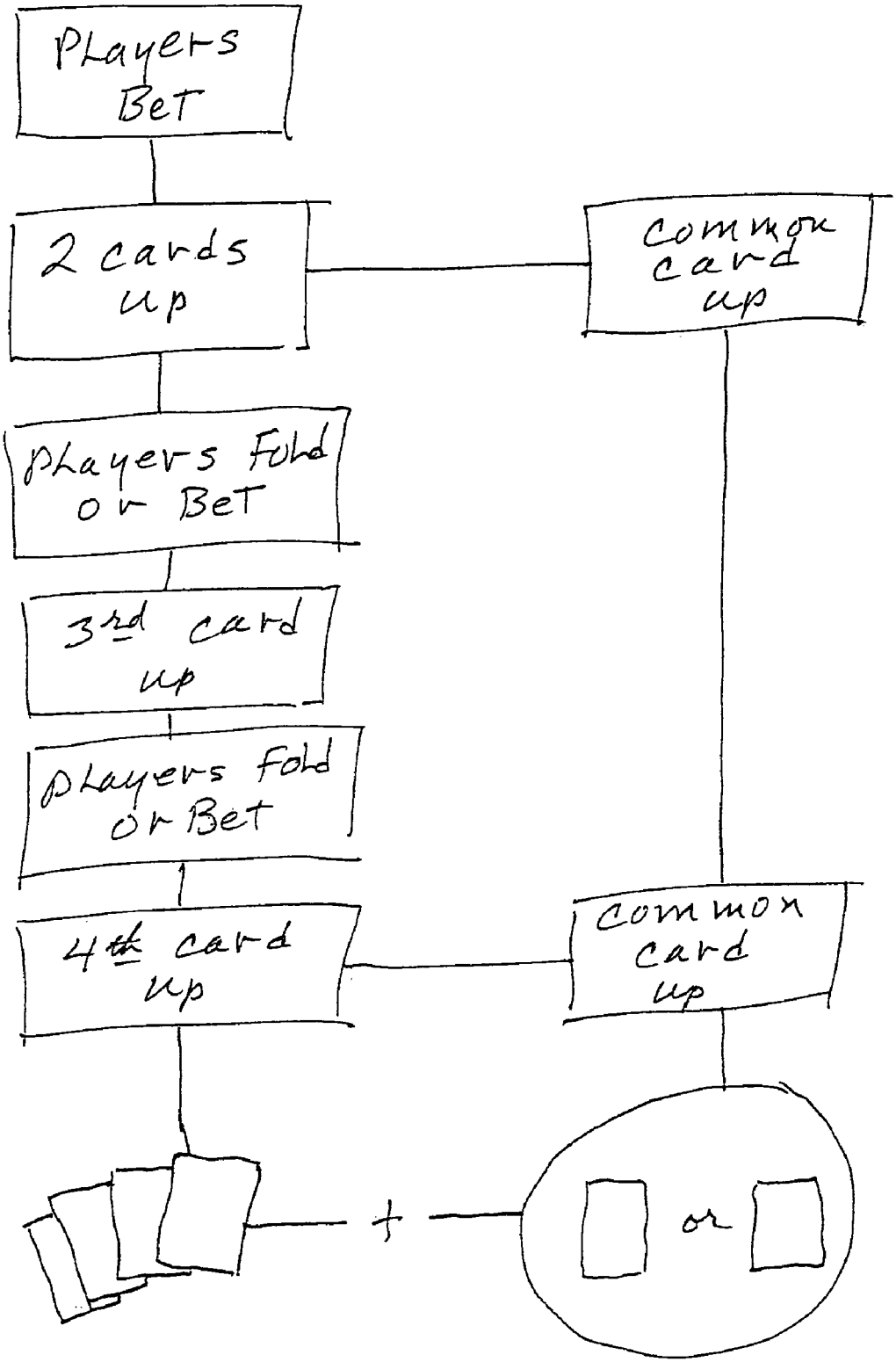

This application claims the benefit of U. S. Provisional Application No. 60/463,533, filed on 17 Apr. 2003, and Provisional Application No. 60/474,118 filed on 29 May 2003, the subject matter of each of which is incorporated herein.

TECHNICAL FIELD

Poker type card games playable in gaming establishments

BACKGROUND

Poker games are perennially popular, but usually involve player versus player and the opportunity of bluffing. Casino games and machine implemented games suitable for play in gaming institutions require that players play against the house and win or lose based on house rules and the probabilities of the cards themselves. Traditional poker games do not meet these requirements, and yet poker remains a popular game for gamblers. A need therefor exists for a poker type game that is interesting and attractive to players and suitable for play by machine and in gaming institutions.

SUMMARY

This invention devises a poker type card game that preserves some of the excitement of poker with cards dealt to players who can make bets in a game with interesting rules playably based on card probabilities. The inventive game is also designed to operate in a gaming establishment or machine environment. The game can be played at tables holding 1–6 players and a dealer for the house who deals out the necessary cards. The game can also be played by computer, video game machine, or slot machine, with a player entering the necessary play decisions into the machine for one or more hands being played at a time. The machine then replaces the dealer, manages the bets and deals the cards by being programmed for card deck probabilities. Either way, the bets of losing hands are collected by the house, and payoffs of wining hands are supplied by the house.

The game is designed to preserve many possibilities for a winning hand until the final round of cards is dealt, to encourage play rather than folding. This preserves some of the excitement of poker games in which a final card dealt can fulfill a winning hand or possibly ruin a promising hand.

The inventive game is based on a poker legend involving Wild Bill Hickcock who was holding two pair of aces and 8's when shot in Deadwood, South Dakota in 1878. The inventive game thus has a theme and can be called "Deadman's Poker", "Wild Bill Poker", or "Aces and 8's", for example. When played by machine, a screen can present an image of Wild Bill Hickock in identifying the aces and 8's theme.

The game involves player bets to receive cards dealt face up in one or more rounds of dealing, and includes two common cards available to all players or hands being played. At the end of the card dealing and betting, each player or hand remaining in the game has four cards that must be used in a poker hand, and makes up the fifth card from one of the two common cards. Two pairs of aces and 8's are the highest winning hand and pay a multiple of the amount bet. The next highest hand is a two pair combination other than aces and 8's, that pays a lower multiple of the amount bet. The lowest winning hand is nothing or less than a pair, which pays the amount bet. All other poker hands, including hands with unpaired aces and 8's are losers that forfeit the amount bet.

DRAWINGS

FIG. 1 schematically shows steps involved in a preferred table version of the inventive game.

Figure 2:
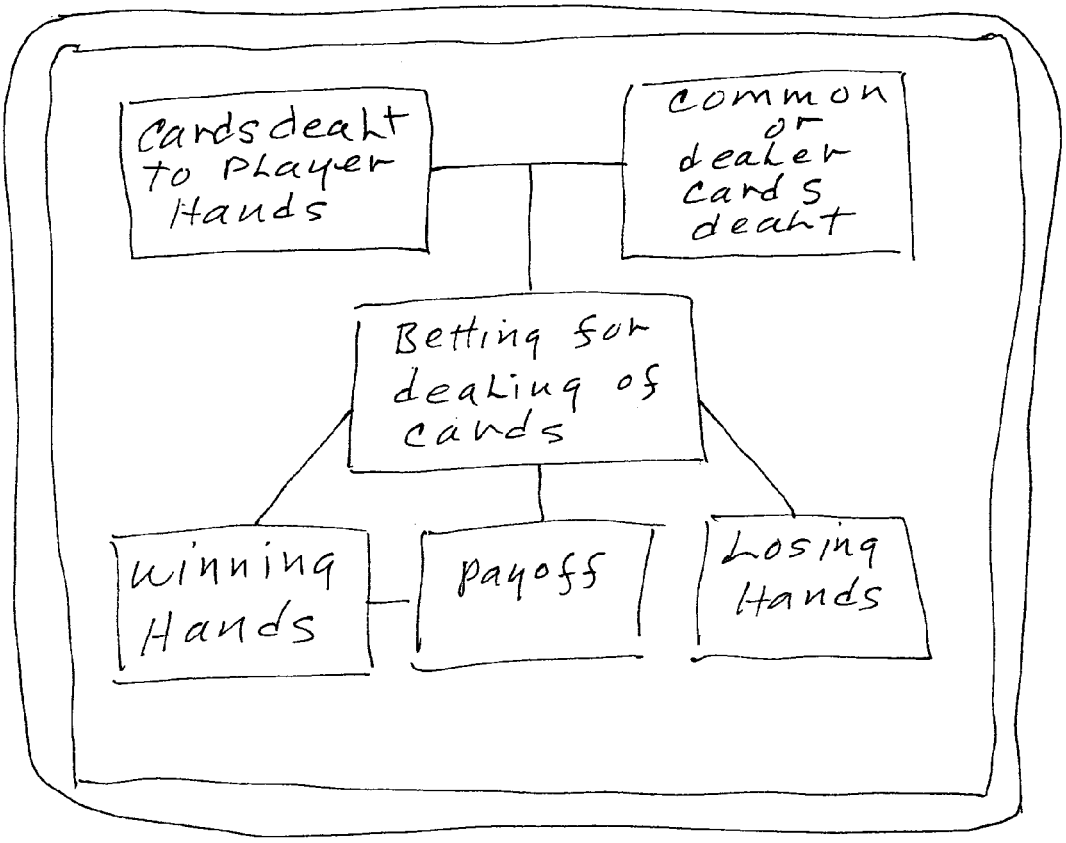

FIG. 2 schematically shows a preferred machine version of the inventive game.

DETAILED DESCRIPTION

The inventive poker type card game is intended for play in gaming establishments, but can also be played in a non-commercial way. It will be described here as intended for play in a gaming establishment or casino, which is sometimes referred to as the "house". The table version is explained first, followed by the machine versions.

Table Version

A dealer will preside at a table marked for player positions and bet positions, and different tables for the game can involve different betting stakes. A minimum or standard bet will apply at each table, and house rules can also require that bets be at the same amount or within a maximum amount. House rules may allow doubling or other increases in the minimum bet as play proceeds.

Each player who wants to play will place the required bet and for the first dealing round will receive two cards face up, with one common card being dealt face up. At this point each player must either bet again or fold and forfeit the amount bet. Each player remaining in the game will then be dealt a third card face up. Once more, each player must either bet again or fold and forfeit the amount bet. Then the final round of cards are dealt with a fourth card face up to each player and a second common card dealt face up. These steps are shown in the drawing, but these dealing preferences can be altered.

At this point, each player must make a poker hand that includes the four cards dealt to that player and one of the common or dealer cards, as also indicated in the drawing. Winning and losing is then determined by the following rules.

The highest possible hand for a player to hold is aces and 8's in a two pair configuration with the fifth card being neither an ace nor an 8. This hand wins the largest amount from the house, which can vary what that amount is, depending on the payoff rate that the house chooses to establish. The suggested payoff rate for aces and 8's is 10-1 of the amount bet. This provides the excitement of a possibly big win.

The second best winning hand is two pair other than aces and 8's, providing that the fifth card is neither an ace nor an 8. One of the two pair could be either aces or 8's, combined with some other card pair. The two pair winning hand of pairs other than aces and 8's pays a smaller multiple of the amount bet, and this also can be varied by the house. The suggested payoff is 2-1 of the amount bet.

The third and smallest winning hand is a hand of nothing in poker terms. Its suggested payoff is equal to the amount bet. This hand must not include an ace or an 8, any pair, or anything higher than a pair. Losing hands thus include an unpaired ace or 8, any single pair, three of a kind, straight, flush, full house, four of a kind, and straight flush. Any losing hand forfeits the amount bet to the house. The smallest winning hand of nothing keeps winning prospects alive for players having no prospects of achieving two pair.

If no pair at all occurs, and the hand is not spoiled by presence of an ace or an 8, a player can win in a low-ball way. This can encourage continued play, rather than folding, in many situations.

Since the final round of cards dealt to players also preferably includes the second common or dealer card, this makes not only the fifth card of each player's hand knowable, but adds a double possibility for what the fifth card can be. This encourages players to stay with the game to learn the final outcome.

At the point of a first betting round after cards have been dealt each player can see two certain cards and one possible card for a poker hand. If an ace or an 8 is involved in the three cards, this can hold the possibility of a high winning hand. It can also hold the possibility of a losing hand if two pair does not occur.

If the three cards showing at this point reveal a pair, this holds the possibility of achieving two pair, and depending on whether the paired cards are both in the player's hand, may also include the possibility of a winning hand with nothing.

After the third card is dealt to each player, more information is available, but winning and losing possibilities still exist. The only hand that cannot possibly win at this stage is three of a kind in the three cards dealt to a player. The final round of cards completes four cards to each player but adds a second common card so that the last two cards produce many more possibilities, for both winning and losing hands.

The game can be varied by dealing an additional common card up at the time that the third cards are dealt to the players. This would greatly change the probabilities involved and therefor would require change in the winning and losing rules, or at least in the payoff multiples used for winning hands.

A player can fold anytime after the first bet, but it is rare that a player's holdings will be so doomed as to preclude any way of winning with the final cards. This helps make folding infrequent.

When the game is played among "friends", one of players can act as the house, and other players can play one or more hands. An aces and 8 hand, or some other rare occurrence could win dealing or house rights to that player. Other game variations can include different rules for varying the minimums or maximums on bets.

Machine Version

A machine or computer version of the game can follow the same rules of card play and the same rules of winning and losing. The rules for dealing and betting can easily change to suit machine purposes, as is common with video card games, which can be programmed to deal cards randomly with the probabilities that occur in card decks. The rules for winning and losing hands preferably remain unchanged while payoff rates for winning hands can vary. FIG. 2 schematically illustrates a machine monitor version of general requirements for playing the game.

The machine can also display information about the game in an attract mode, and can display the usual prompts and information needed to guide players through the necessary decisions. Machine versions of the game can also allow a single player to play several hands at a time. The player must make the necessary decisions for each hand on whether to fold or bet and receive an additional card. The machine will preferably be programmed to facilitate the decisions that must be made by the player, provide the necessary prompts and guides to help the player along, manage all the bets and payoffs, and supply all the usually attractive video graphics, and possibly audio sounds to help stimulate play. The displays can include logos and symbols identifying the game, rules of the game, odds involved in playing the game, and even payoff rates, depending on house policies.

Machine versions of the game can be divided into two general categories—a minimal player involvement version similar to slot machine play, and a more extensive player involvement version similar to video poker. All versions of the game preferably keep the same winning hand combinations as explained above, but they can use considerable variety in the dealing of cards and arranging of antes and bets.

Slot Version

A preferred sequence for a slot version of the game allows a player to play from one to five hands at a time, with an ante bet made for each hand. A player is then dealt a portion of the cards to be received, and the portion can vary. Three cards dealt to each player hand and one dealer card per hand is preferred, also a separate deck can be used for each hand and can be shuffled after each game. The player would then preferably have a chance to stay with the original bet or double the bet on any of the hands that look promising based on the four cards that are now visible. Then the final two cards can be dealt—one card to each hand and one more dealer or common card per hand. At this point, each hand being played contains four cards, and can use one of two dealer cards, and the machine can evaluate and establish whether hands are winners or losers. The play sequence can thus involve from one to only a few decisions made by a player for each of the hands being played.

One of the advantages of playing five hands at a time is the possibility of huge payoffs for more than one winning hand of aces and 8's at a time. This would occur very rarely by card deck probabilities, and could therefore justify a very large payoff. Five simultaneous winning hands of aces and 8's is an elusive but possible reality with multi deck play, and a payoff for this phenomenon could be high enough to attract considerable player interest. Assuming a separate card deck for each hand played, for example, and assuming that card deck probabilities permitted, payoffs for multiple winning hands of aces and 8's might be set at:

| No. of winning hands of Aces and 8's | Payoff |
|---|---|
| 5 | 10,000 to 1 |
| 4 | 1,000 to 1 |
| 3 | 100 to 1 |
| 2 | 50 to 1 |
| 1 | 15 to 1 |

Similarly graduated and much lower payoff rates could be applied to multiple winning hands of two pairs other than aces and 8's. The goal could be an overall payback rate of somewhat less than 100% that is arranged to include some especially high payoffs for rarely encountered multiple winning hands.

Video Version

A video poker version of the game requiring more player involvement would preferably deal four cards to a single player hand and one dealer card after the original ante bet. The player could then stand pat with the five original cards, or could discard and receive substitutes for from one to four of the originally dealt player cards, depending on house rules. A second dealer card is dealt along with any substitute cards dealt to replace the discards, and the machine can then determine from the above described rules whether a winning hand exists from the final six cards.

Discard decisions that must be made when the game is played this way require player involvement in strategic decisions. Judgements must be made on which cards to hold and which cards to replace, and this introduces a skill requirement allowing different players to play at different levels of ability. The payoff rate would be established so that the most expert play receives a payback of slightly less than 100%. Less than expert play would then produce a smaller payback.

Jokers, which can be in the image of Wild Bill Hickock, can be used as killer cards to reduce the frequency of winning hands and correspondingly allow higher payoffs when winning hands occur. Any originally dealt joker must be discarded in a video poker version of the game, and the occurrence of a joker as a final card can spoil a hand that otherwise held a winning card combination. A joker can then function like an unpaired ace or 8.

GAMES VERSION SUMMARY

Wild Bill Poker; Deadman's Poker
1. Table Game—Strategy—wagering
a. Ante
b. 2 cards up to player; one up to dealer
c. Bet or fold
d. $3^{rd}$ card up to player
e. Bet or fold (may increase bet ×2 or ×3)
f. $4^{th}$ card to player up and $2^{nd}$ card to dealer up
g. Win or lose
2. Slot Game—Strategy—wagering
a. Play 1 to 5 games at a time
b. Ante
c. 3 cards to player displayed per hand and one to dealer
d. May double bet or not
e. $4^{th}$ card to player and $2^{nd}$ to dealer; computer picks best dealer card
f. Win or lose
3. Video Poker Game—Strategy—card selection
a. One game at a time replicating existing video poker format with 2 pair of
ace and 8's as highest hand; 2 pair (with no kill card) as $2^{nd}$ highest and
nothing (with no kill card) as $3^{rd}$ highest
b. Ante
c. Deal 4 cards to player and one to dealer
d. Possible additional bet
e. Discard, draw, and $2^{nd}$ card to dealer
f. Must have 2 pair or nothing without a kill card
2 pair Ace and 8's—highest
2 pair anything—2nd highest
Nothing—$3^{rd}$ highest

What is claimed is:

1. A poker gaming method including a system of betting and dealing cards from which a player can assemble a 5 card poker hand, and the method involving rules of winning and losing for poker hands comprising:
a. a player having a pair of aces and a pair of 8's with a fifth card that is neither an ace or an 8 has the highest hand and wins a predetermined multiple of the total amount that player has bet;
b. a player having any two pair other than aces and 8's with a fifth card that is neither an ace nor an 8 has the second highest hand and is paid a lower predetermined multiple of the amount that player has bet;
c. a player having less than one pair and neither an ace nor an 8, has the smallest winning hand and wins the amount that player has bet; and
d. a player having anything other than defined in paragraphs a–c loses and forfeits the amount that player has bet.

2. The poker gaming method of claim 1 wherein the poker hands are made from 4 player cards and a choice of 1 of 2 dealer cards.

3. The poker gaming method of claim 1 wherein more than one bet by the player is required to complete a poker hand.

4. The poker gaming method of claim 1 wherein a single player plays a plurality of the poker hands.

5. The poker gaming method of claim 4 wherein each player hand is made from 4 cards dealt to the hand and a selected one of two dealer cards.

6. The poker gaming method of claim 1 wherein a machine deals the cards to the poker hands.

7. The poker gaming method of claim 1 programmed into a video gaming machine, slot machine, or computer.

8. The poker gaming method of claim 7 wherein a player plays more than one hand for each round of cards dealt.

9. A poker game comprising:
a. for dealing four cards to each player hand and two dealer cards common to the player hands, so that one of the two dealer cards is selectable to make a poker hand for each of the player hands;
b. a player having a poker hand containing a pair of aces and a pair of 8's with a fifth card that is neither an ace nor an 8 has the highest hand and wins a predetermined multiple of the total amount that player has bet;
c. a player having a poker hand containing any two pair other than aces and 8's with a fifth card that is neither an ace nor an 8 has the second highest hand and is means paid a lower predetermined multiple of the amount that player has bet;
d. a player having a poker hand containing less than one pair and neither an ace nor an 8, has the smallest winning hand and wins the amount that player has bet; and
e. a player having a poker hand containing anything other than defined in paragraphs b–d loses and forfeits the amount that player has bet.

10. The poker game of claim 9 programmed into a gaming machine or computer.

11. The poker game of claim 9 wherein more than one bet by the player is required to complete a poker hand.

12. The poker game of claim 9 wherein the means for dealing is a programmed machine.

13. The poker game of claim 9 wherein the final card dealt is the second dealer card.

14. A poker game comprising:
a. a poker hand made from four cards dealt to a player and one of two dealer cards;
b. the poker hand winning a highest multiple of an amount bet if it contains two pair of aces and 8's and no unpaired ace or 8;
c. the poker hand winning a lower multiple of an amount bet if it contains two pair other than aces and 8's and no unpaired ace or 8; and
d. the poker hand winning an amount bet if it contains less than a pair and no unpaired ace or 8.

15. The poker game of claim 14 including rules of card play requiring betting during dealing of the four player cards and the two dealer cards.

16. The poker game of claim 14 programmed into a machine that deals the cards, handles betting, and determines payoffs.

17. The poker game of claim 14 wherein the machine deals more than one four card hand to the player.

* * * * *